US009200410B2

(12) United States Patent
Koike et al.

(10) Patent No.: US 9,200,410 B2
(45) Date of Patent: Dec. 1, 2015

(54) ELECTROPHOTOGRAPHIC RECORDING SHEET AND RECORDED MATERIAL

(75) Inventors: Hiroshi Koike, Ibaraki (JP); Seiichiro Iida, Ibaraki (JP); Koichi Ishida, Tokyo (JP)

(73) Assignee: YUPO CORPORATION, Tokyo (JP)

( * ) Notice: Subject to any disclaimer, the term of this patent is extended or adjusted under 35 U.S.C. 154(b) by 692 days.

(21) Appl. No.: 12/601,015

(22) PCT Filed: May 22, 2008

(86) PCT No.: PCT/JP2008/001277

§ 371 (c)(1), (2), (4) Date: May 13, 2010

(87) PCT Pub. No.: WO2008/142869

PCT Pub. Date: Nov. 27, 2008

(65) Prior Publication Data

US 2010/0291363 A1 Nov. 18, 2010

(30) Foreign Application Priority Data

May 22, 2007 (JP) ..... 2007-135023
May 30, 2007 (JP) ..... 2007-144097

(51) Int. Cl.
*G03G 7/00* (2006.01)
*D21H 27/30* (2006.01)
*D21H 27/00* (2006.01)
(Continued)

(52) U.S. Cl.
CPC ..... *D21H 21/14* (2013.01); *D21H 19/80* (2013.01); *D21H 27/14* (2013.01); *G03G 7/004* (2013.01); *Y10T 428/24934* (2015.01); *Y10T 428/2848* (2015.01); *Y10T 428/3179* (2015.04); *Y10T 428/31551* (2015.04); *Y10T 428/31678* (2015.04); *Y10T 428/31786* (2015.04);
(Continued)

(58) Field of Classification Search
CPC ..... G03G 7/004
USPC ..... 428/195.1
See application file for complete search history.

(56) References Cited

U.S. PATENT DOCUMENTS 2,767,107 A * 10/1956 Berry et al. ..... 427/381
3,681,070 A 8/1972 Timmerman et al.
(Continued)

FOREIGN PATENT DOCUMENTS

JP 48-023451 3/1973
JP 59-93454 5/1984
(Continued)

OTHER PUBLICATIONS

Supplementary European Search Report issued with respect to European Patent App. No. 08751789.2, dated Mar. 23, 2011.
(Continued)

*Primary Examiner* — Mark Ruthkosky
*Assistant Examiner* — Ian Rummel
(74) *Attorney, Agent, or Firm* — Greenblum & Bernstein, P.L.C.

(57) ABSTRACT

An electrophotographic recording sheet having, on a water-resistant support, a toner-receiving layer containing a liphophilic polymer antistatic agent with a specific surface resistivity of from $1\times10^{7}$ to $9\times10^{12}\Omega$. This electrophotographic recording sheet is excellent in recording quality, fixability, water resistance, durability, color printability and continuous printability.

18 Claims, 1 Drawing Sheet

(51) Int. Cl.

| | |
|---|---|
| ***B32B 27/10*** | (2006.01) |
| ***B32B 27/18*** | (2006.01) |
| ***D21H 21/14*** | (2006.01) |
| ***D21H 19/80*** | (2006.01) |
| ***D21H 27/14*** | (2006.01) |

(52) U.S. Cl.

CPC .. *Y10T428/31906* (2015.04); *Y10T 428/31928* (2015.04); *Y10T 428/31935* (2015.04)

(56) References Cited

U.S. PATENT DOCUMENTS

| | | | | |
|---|---|---|---|---|
| 4,480,003 | A | 10/1984 | Edwards et al. | |
| 7,109,258 | B1 * | 9/2006 | Valeri et al. | 523/457 |
| 2003/0104180 | A1 * | 6/2003 | Shikano et al. | 428/195 |
| 2003/0157299 | A1 | 8/2003 | Nitta et al. | |
| 2004/0086715 | A1 | 5/2004 | Nakashima | |
| 2005/0170155 | A1 * | 8/2005 | Goto et al. | 428/195.1 |

FOREIGN PATENT DOCUMENTS

| | | |
|---|---|---|
| JP | 8-011263 | 1/1996 |
| JP | 8-262780 | 10/1996 |
| JP | 8-297375 | 11/1996 |
| JP | 9-150573 | 6/1997 |
| JP | 11-147365 | 6/1999 |
| JP | 11-227324 | 8/1999 |
| JP | 2000-131870 | 5/2000 |
| JP | 2000-335087 | 12/2000 |
| JP | 2002-055615 | 2/2002 |
| JP | 2002-062678 | 2/2002 |
| JP | 2002-91049 | 3/2002 |
| JP | 2002-341580 | 11/2002 |
| JP | 2004-083689 | 3/2004 |
| JP | 2004-157184 | 6/2004 |
| JP | 2004-293001 | 10/2004 |
| JP | 2005-212299 | 8/2005 |
| JP | 2005-215346 | 8/2005 |
| JP | 2005-271396 | 10/2005 |
| JP | 2006-150615 | 6/2006 |
| JP | 2006-199873 | 8/2006 |
| WO | 02/088847 | 11/2002 |

OTHER PUBLICATIONS

International Search Report dated Jun. 17, 2008 that issued with respect to PCT/JP2008/001277.

International Preliminary Report on Patentability, including the Written Opinion (in English) mailed Jan. 21, 2010 that issued with respect to PCT/JP2008/001277.

Office Action issued with respect to patent family member Japanese Patent Application No. 2007-144097; mailed Jul. 3, 2012.

Office Action issued with respect to patent family member Japanese Patent Application No. 2007-135023; mailed Jul. 3, 2012.

Notice of Allowance issued with respect to patent family member Japanese Patent Application No. 2007-144097, mailed Feb. 5, 2013.

Japan Office action, dated Mar. 26, 2013 along with an english translation thereof.

* cited by examiner

ELECTROPHOTOGRAPHIC RECORDING SHEET AND RECORDED MATERIAL

TECHNICAL FIELD

The present invention relates to an electrophotographic recording sheet favorable for use in color recording according to electrophotographic recording systems such as duplicators, laser printers, etc., which is excellent in the recording quality thereof such as the density, the color tone, the gradation and others and is also excellent in the fixability, the water resistance and the durability, and in particular, the electrophotographic recording sheet is free from static blocking even in continuous printing thereon.

BACKGROUND ART

The recent progress of duplicators and printers is remarkable, and these are being drastically improved not only in point of the cost thereof but also the performance thereof such as the recording quality, the recording speed and others. Accordingly, at present, printed materials such as posters, catalogs, pamphlets and others that have been heretofore produced by the use of printing machines have become produced more simply and more rapidly by the use of duplicators or printers while maintaining the recording quality as before. Recording with such duplicators or printers is especially favorable in quickly producing a variety of but a small number of printed copies.

Of various types of duplicators and printers, electrophotographic duplicators and printers, especially those driven by semiconductor laser are excellent in point of high resolution and rapid recording capability. Electrophotographic system enhancement technology toward color image formation has some problems in that the apparatus must be large-sized as requiring plural developing devices and that the color tone of the image formed is slightly poor as pigment is used for the toner colorants. However, these problems are being solved by downsizing the apparatus and by improving the materials for toners, recording sheets, etc.

Regarding the improvement of recording sheets, an electrophotographic recording sheet laminated with a synthetic resin film having a coating layer on at least one surface of a substrate layer made of a water-resistant paper material (Patent Reference 1) has been invented and put into practical use, which is more excellent in the recording quality, the fixability, the water resistance and the durability than conventional electrophotographic recording sheets made of pulp paper.

However, the conventional electrophotographic recording sheet laminated with a synthetic resin film having a coating layer thereon, on at least one surface of the substrate layer made of a water-resistant paper material is, though excellent in the recording quality, the fixability, the water resistance and the durability, still problematic in that, in continuous printing thereon, the static charge given to the recoding sheet inside the printer could not be well discharged, and therefore, when the printed sheets are left as piled up after printing thereon, then they may often block together and (at their edges) may be difficult to pile up uniformly (at their edges). Accordingly, when the printed materials are further worked by cutting or blanking, then they may have another drawback in that their size may differ and their pattern position may fluctuate. As recording sheets that are prevented from being statically charged after printing and are therefore prevented from blocking together, there are proposed those coated with an antistatic agent (see Patent References 2 to 4); and those in which an antistatic agent is added to the toner-receiving coating layer (see Patent References 5 to 7).

However, the proposals heretofore made in Patent References 2 to 7 are for those coated with a water-soluble antistatic agent as a simple substance thereof, and those for which a water-soluble antistatic agent is added to the water-base coating material. Accordingly, these are still problematic in that, though their supports are resistant to water by themselves, the coating layers are still poorly resistant to water, and therefore they are not durable in practical use such as outdoor use, etc. These coating layers are too hydrophilic, and therefore, when the printed materials are dipped in water for 24 hours and then the printed surfaces are rubbed strongly, then the toner is readily peeled off along with the coating layer, or that is, the coating layer is incomplete.

On the other hand, an electrophotographic recording sheet that comprises a moisture-absorbing (ambient humidity-dependent) antistatic agent has some drawbacks in that the printed sheet could not stably exhibit the antistatic capability owing to the reduction in the relative humidity around the surface of the sheet that is overheated with the toner fixing unit of the electrophotographic recording system used and that, in continuous printing in low-humidity environments in the winter season or the like, the printed sheets may often block together.

Patent Reference 1: JP-A 2002-091049
Patent Reference 2: JP-A 8-297375
Patent Reference 3: JP-A 2000-131870
Patent Reference 4: JP-A 2004-083689
Patent Reference 5: JP-A 8-011263
Patent Reference 6: JP-A 2004-083689
Patent Reference 7: JP-A 2005-271396

DISCLOSURE OF THE INVENTION

Problems that the Invention is to Solve

It is desired to solve the problems with such conventional electrophotographic recording sheets, or that is, excessive static charging, poor water resistance of the toner-receiving coating layer, and humidity dependence of the toner-receiving coating layer of those sheets. Given that situation, an object of the present invention is to provide an electrophotographic recording sheet favorable for use in color recording in duplicators, laser printers, etc., which is excellent in the recording quality thereof such as the density, the color tone, the gradation and others, excellent in the recording fixability, the water resistance and the durability, and excellent in the continuous printability thereof with no static surface blocking even in continuous printing thereon.

Means for Solving the Problems

To solve these problems, the present inventors have assiduously studied and, as a result, have found that an electrophotographic recording sheet having the desired characteristics can be provided by controlling the specific surface resistivity of the toner-receiving layer by the use of a liphophilic polymer antistatic agent therein, and have completed the present invention.

Specifically, the invention relates to an electrophotographic recording sheet having, on at least one surface of the water-resistant support thereof, a toner-receiving layer containing a liphophilic polymer antistatic agent, wherein the specific surface resistivity of the toner-receiving layer at a temperature of 25° C. and a relative humidity of 20% is from $1\times10^{7}$ to $9\times10^{12}\Omega$.

The polymer antistatic agent for use in the invention is liphophilic, and in order to express its excellent antistatic capability not depending on the environmental humidity, it preferably contains an alkylene oxide group and/or a hydroxyl group, and an alkali metal ion in the molecule. More concretely, the polymer antistatic agent has a (meth)acrylic polymer skeleton of the following structural formula (1):

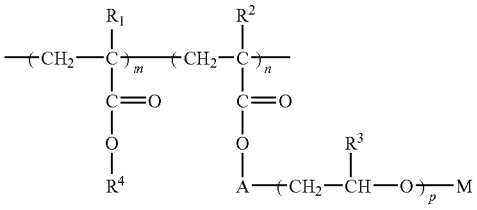

wherein $R^1$ and $R^2$ each independently represent a hydrogen atom or a methyl group; $R^3$ represents a hydrogen atom, a chlorine atom or a methyl group; $R^4$ represents an alkyl group having from 1 to 30 carbon atoms; A represents one linking group selected from the following <Group 1>, or a linking group formed by alternately bonding one or more linking groups selected from the following <Group 1> and one or more linking groups selected from the following <Group 2>, or a single bond;

<Group 1> an alkylene group having from 1 to 6 carbon atoms and optionally having a substituent, an arylene group having from 6 to 20 carbon atoms and optionally having a substituent;

<Group 2> —CONH—, —NHCO—, —OCONH—, —NHCOO—, —NH—, —COO—, —OCO—, —O—;

M represents an alkali metal; m indicates an integer of from 0 to 300; n indicates an integer of from 1 to 300; and p indicates an integer of from 1 to 100.

In particular, when the alkyl group, the alkylene group or the like for $R^4$ and A, or the alkylene oxide group has a sufficiently large number of carbon atoms, then the polymer antistatic agent satisfies the feature of liphophilicity and therefore can be dissolved in an organic solvent along with a binder resin to produce a solution coating material. When this is applied onto a support and dried thereon to form a filmy toner-receiving layer, then it may exhibit excellent water resistance and durability not given before, owing to the contribution of the binder resin thereto. The excellent water resistance is strong and firm, for example, to such a degree that when the printed recording sheet is dipped in water in a vat filled with water for 24 hours in such a manner that the sheet does not float up, and then the recorded image is strongly rubbed with a coin or the like, there is no change in the recorded image. Further, the polymer antistatic agent is an anionic antistatic agent having an alkali metal ion represented by M at the alkoxy terminal thereof. As having an alkali metal ion, the polymer antistatic agent satisfies a feature of ionic conductivity and can express its excellent antistatic capability not depending on the environmental humidity.

Preferably, the toner-receiving layer contains from 0.01 to 1% by weight of an alkali metal ion, and the alkali metal ion is preferably a lithium ion. Also preferably, the toner-receiving layer contains from 1 to 50% by weight of a polymer antistatic agent and from 10 to 99% by weight of a binder resin; and optionally, it may contain up to 70% by weight of pigment particles. However, the layer may not contain pigment particles.

The binder resin is preferably any of polyether urethane, polyester urethane, polyacrylic urethane, acrylic ester copolymer and/or their mixture.

In order to enhance the water resistance of not only the toner-receiving layer but also the entire electrophotographic recording sheet, preferably, the support is also resistant to water. Concretely, the support is preferably one produced by laminating a synthetic resin film on at least one surface of a water-resistant paper material.

Further, for the purpose of preventing the support from yellowing through exposure to UV rays in outdoor use of the electrophotographic recording sheet, the support preferably has a UV-intercepting layer laminated between the water-resistant paper material and the synthetic resin film.

Preferably, the water-resistant paper material is a poorly water-absorbing paper material of which the water absorbency according to the Cobb's method based on JIS-P-8140: 1998 falls within a range of from 0 to 50 g/m$^2$. Concretely preferred are processed paper materials selected from the group consisting of bases for diazo photosensitive paper materials, bases for photographic printing paper materials, resin-infiltrated paper materials, resin-coated paper materials, vegetable parchment materials, artificial parchment materials, water-resistant paper materials, oil-resistant paper materials and waterproof paper materials, or polyolefin films containing an inorganic and/or organic fine powder.

Preferably, the synthetic resin film is a resin film containing a thermoplastic resin having a melting point of from 180 to 300° C. Concretely preferred is a polyester resin film or a resin film containing poly(4-methylpent-1-ene). The polyester resin is preferably polyethylene terephthalate.

The UV-intercepting layer preferably contains at least one UV absorbent selected from the group consisting of benzotriazole-type, benzophenone-type, salicylate-type, cyanoacrylate-type, nickel-containing and triazine-type UV absorbents. The amount of the UV absorbent in the layer composition is preferably from 1 to 50% by weight.

The electrophotographic recording sheet of the invention can immediately release static charges, but on the other hand, its electrostatic capacity is preferably so controlled as to fall within a range of from 10 to 300 pF/cm$^2$ in order that the recording quality thereof such as the density, the color tone and the gradation can be good.

The electrophotographic recording sheet of the invention may be in the form of a sticker label sheet having a sticking paste layer laminated on one outermost layer thereof. Recording images including informations such as bar codes and others may be recorded, printed or patterned on the electrophotographic recording sheet to be recorded materials.

EFFECT OF THE INVENTION

Color recording on the electrophotographic recording sheet of the invention gives images excellent in recording quality such as density, color tone, gradation, etc. The electrophotographic recording sheet of the invention exhibits good fixability, water resistance and durability, and is free from static blocking even in continuous printing thereon, and is excellent in practicability.

Figure 1:
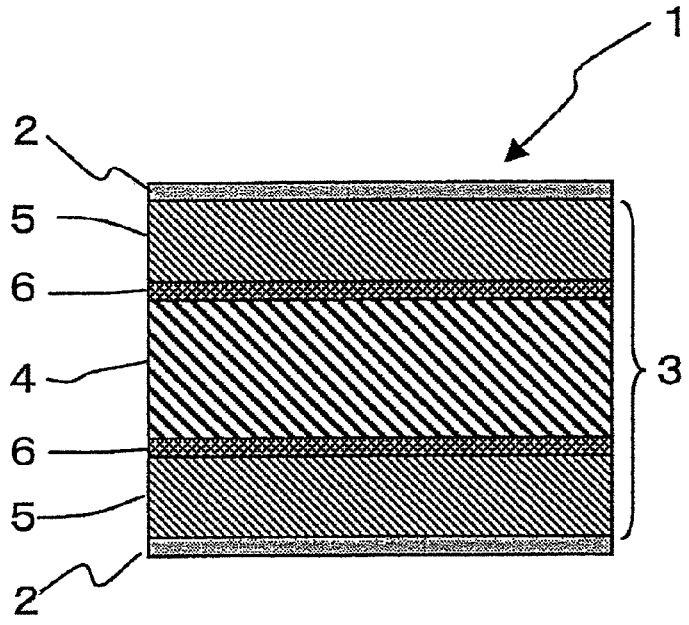
FIG. 1 It is a partly-enlarged cross-sectional view of one embodiment of the electrophotographic recording sheet of the invention.

In the drawings, 1 is an electrophotographic recording sheet, 2 is a toner-receiving layer, 3 is a support, 4 is a paper material, 5 is a synthetic resin film, 6 is an adhesive layer, 7 is a protective layer.

BEST MODE FOR CARRYING OUT THE INVENTION

The electrophotographic recording sheet and the recorded material of the invention are described in detail hereinunder. The description of the constitutive elements of the invention given hereinunder is for some typical embodiments of the invention, to which, however, the invention should not be limited. In this description, the numerical range expressed by the wording "a number to another number" means the range that falls between the former number indicating the lowermost limit of the range and the latter number indicating the uppermost limit thereof.

<<Electrophotographic Recording Sheet>>

[Characteristic and Layer Constitution]

Figure 2:
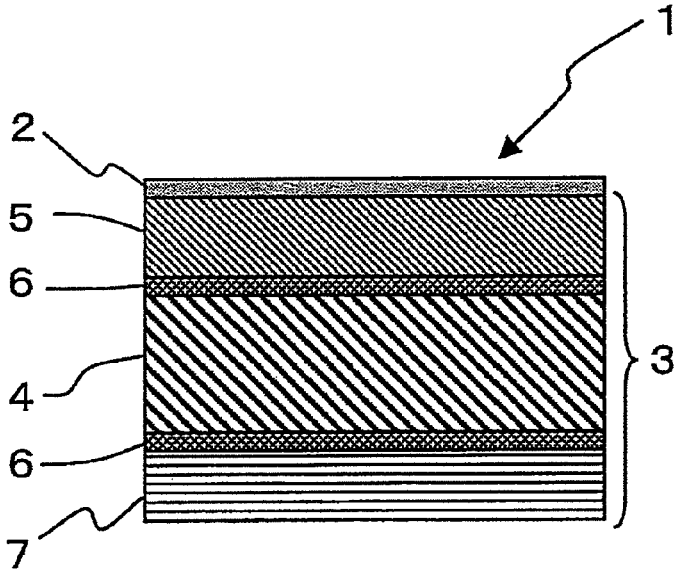
FIG. 2 It is a partly-enlarged cross-sectional view of another embodiment of the electrophotographic recording sheet of the invention.

The electrophotographic recording sheet of the invention is a sheet having, on at least one surface of the water-resistant support thereof, a toner-receiving layer containing a polymer antistatic agent, wherein the specific surface resistivity of the toner-receiving layer at a temperature of 25° C. and a relative humidity of 20% is controlled to be from $1\times10^{7}$ to $9\times10^{12}\Omega$. FIG. 1 and FIG. 2 show preferred embodiments of the electrophotographic recording sheet of the invention having the above characteristic. The electrophotographic recording sheet 1 of the invention shown in FIG. 1 has a toner-receiving layer 2 provided on both surfaces of a water-resistant support 3. The electrophotographic recording sheet 1 of the invention shown in FIG. 2 has a toner-receiving layer 2 provided only on one surface of a water-resistant support 3. As in FIG. 1 and FIG. 2, the support 3 may have a laminate structure where a synthetic resin film 5 is laminated on both surfaces of the paper material 4 via the adhesive layer 6 therebetween.

The thickness of the electrophotographic recording sheet of the invention may be generally from 70 to 400 μm, preferably from 85 to 350 μm, more preferably from 100 to 300 μm. The weight of the sheet may be generally from 70 to 400 g/m$^2$, preferably from 85 to 350 g/m$^2$, more preferably from 100 to 300 g/m$^2$.

The layers and the support constituting the electrophotographic recording sheet of the invention are described below, and the physical properties of the electrophotographic recording sheet are mentioned.

[Toner-Receiving Layer]

(Characteristic and Function)

The toner-receiving layer for use in the electrophotographic recording sheet of the invention contains a polymer antistatic agent so that its specific surface resistivity at a temperature of 25° C. and a relative humidity of 20% could be within a range of from $1\times10^{7}$ to $9\times10^{12}\Omega$.

The toner-receiving layer for use in the electrophotographic recording sheet of the invention is the outermost layer of the electrophotographic recording sheet, and this receives a toner in electrophotographic printing (copying or laser printing) thereon; and in particular, it is excellent in water resistance and durability and prevents static charging after printing, therefore realizing an electrophotographic recording sheet free from surface blocking after printing thereon.

(Conventional Antistatic Agent)

Heretofore, as an antistatic agent, generally well used is a monomer-type antistatic agent such as typically stearic acid monoglyceride, alkyldiethanolamine, sorbitan monolaurate, alkylbenzenesulfonic acid salt, alkyldiphenyl ether sulfonic acid salt, etc. However, these are highly soluble in water and their cohesive force is weak; and therefore these are problematic in that, when used in an amount enough to exhibit the antistatic capability thereof, they extremely worsen the water resistance of the layer.

An electroconductive inorganic filler such as typically ITO (indium-doped tin oxide), ATO (antimony-doped tin oxide), graphite whisker or the like could not also exhibit an antistatic effect when added in a small amount, since the filler particles could not be kept in contact with each other. When the filler is added in an amount enough to make the filler particles kept in contact with each other, then the binder amount shall be extremely low thereby to lower the water resistance of the layer, and there occurs a problem in that the layer could hardly satisfy both water resistance and antistatic property.

On the other hand, a polymer antistatic agent has a cohesive force by itself, and therefore enables formation of a coating layer excellent in water resistance.

Some polymer antistatic agents such as polythiophene, polypyrrole, polyaniline and the like are so-called electroconductive polymers capable of exhibiting electroconductivity owing to the π-bond in the molecular chain; but these electroconductive polymers are generally colored to be black, green or bluish gray owing to the conjugated system-derived coloration thereof; and when used, they may provide an excellent antistatic effect, but may make the electrophotographic recording sheet colored in a dark color, and the recording sheet may give indistinct images. Further, the electrophotographic polymers of the type are characterized by having high electroconductivity, and their ability to diffuse electric charges is also too high; and therefore they have another characteristic in that they discharge charged toners. To that effect, the electroconductive polymers could hardly satisfy the necessary electrostatic capacity not excessive and not insufficient for electrophotographic recording sheets, and therefore often cause a trouble of instability of image density.

(Polymer Antistatic Agent for Use in the Invention)

The polymer antistatic agent for use in the invention must have both antistatic capability and water-resistant capability, and must be such that its antistatic effect is influenced little by the heating step with an electrophotographic toner-fixing unit. Specifically, the polymer antistatic agent for use in the invention is a liphophilic polymer antistatic agent enabling the specific surface resistivity of the toner-receiving layer 25° C. in temperature and 20% in relative humidity to fall within a range of from $1\times10^{7}$ to $9\times10^{12}\Omega$. As being liphophilic, the polymer antistatic agent may be combined with a binder resin having a higher degree of water resistance. "Liphophilic" as referred to herein means that the agent dissolves in an organic solvent mentioned below, in an amount of at least 5% by weight as the solid concentration thereof, and does not form a precipitate. The polymer antistatic agent for use in the invention is preferably a copolymer of a monomer that exhibits antistatic capability and a hydrophobic (oleophilic) monomer. As copolymerized with a hydrophobic monomer, the copolymer may have an increased solubility in various organic solvents. The hydrophobic monomer includes esters of acrylic acid or methacrylic acid with various alcohols.

The polymer antistatic agent for use in the invention is more preferably an ion-conductive antistatic agent having an alkylene oxide group and/or a hydroxyl group in the molecule and having an alkali metal ion having a relatively small ion diameter, such as a lithium ion, a sodium ion, a potassium ion or the like, as the counter ion to the hydroxyl group. For example, an antistatic agent having a copolymer structure of the following formula (1) comprises a unit with an alkylene oxide group that exhibits antistatic capability and a unit with an oleophilic group that contributes toward water-resistant capability (enhances oleophilicity), and is therefore a preferred embodiment as realizing an antistatic agent excellent in water resistance. The ratio and the degree of polymerization of the individual units may be determined according to the intended antistatic capability and water-resistance capability.

Formula (1):

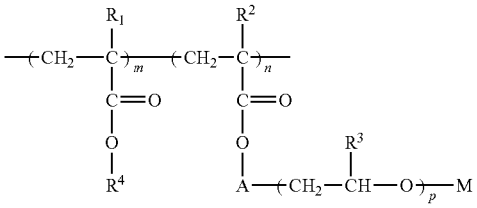

In formula (1), $R^1$ and $R^2$ each independently represent a hydrogen atom or a methyl group. When m is 2 or more, then m' $R^1$'s may be the same or different. When n is 2 or more, then n' $R^2$'s may be the same or different. Accordingly, all $R^1$ and $R^2$ may be methyl groups.

In formula (1), $R^4$ represents an alkyl group having from 1 to 30 carbon atoms. The number of the carbon atoms constituting the group may be selected, for example, from 1 to 25, preferably from 2 to 23, more preferably from 3 to 20, even more preferably from 4 to 18. Specific examples of the alkyl group include a methyl group, an ethyl group, a propyl group, a butyl group, a pentyl group, a hexyl group, a heptyl group, a dodecyl group, a tridecyl group, a stearyl group, etc. These may be linear or branched. When m is 2 or more, then m' $R^4$'s may be the same or different. For example, the formula may have both an alkyl group having less than 10 carbon atoms and an alkyl group having 10 or more carbon atoms as combined; or may have both an alkyl group having from 1 to 6 carbon atoms and an alkyl group having from 15 to 20 carbon atoms as combined.

In formula (1), A represents one linking group selected from the following <Group 1>, or a linking group formed by alternately bonding one or more linking groups selected from the following <Group 1> and one or more linking groups selected from the following <Group 2>, or a single bond:

<Group 1> an alkylene group having from 1 to 6 carbon atoms and optionally having a substituent, an arylene group having from 6 to 20 carbon atoms and optionally having a substituent;

<Group 2> —CONH—, —NHCO—, —OCONH—, —NHCOO—, —NH—, —COO—, —OCO—, —O—.

The alkylene group having from 1 to 6 carbon atoms in <Group 1> includes a methylene group, an ethylene group, a propylene group, a butylene group, a pentylene group, a hexylene group. These may be linear or branched, but are preferably linear. The substituent includes a hydroxyl group, an aryl group, etc. The arylene group having from 6 to 20 carbon atoms includes a phenylene group, a naphthylene group, an anthrylene group. The substituent includes a hydroxyl group, an alkyl group, etc. The arylene group substituted with an alkyl group includes a tolylene group, a xylylene group, etc. The linking group selected from <Group 2> is preferably an urethane group or an ester group. The linking group formed by alternately bonding one or more linking groups selected from <Group 1> and one or more linking groups selected from <Group 2> includes a linking group represented by "(linking group selected from Group 1)-(linking group selected from Group 2)", a linking group represented by "(linking group selected from Group 1)-(linking group selected from Group 2)-(linking group selected from Group 1)-(linking group selected from Group 2)", etc. In the latter case, two types of the (linking group selected from Group 1) may be the same or different; and two types of the (linking group selected from Group 2) may be the same or different.

In formula (1), $R^3$ represents a hydrogen atom, a chlorine atom or a methyl group, preferably a hydrogen atom or a methyl group. When p is 2 or more, then p' $R^3$'s may be the same or different, but are preferably the same. p indicates an integer of from 1 to 100, preferably from 2 to 50, more preferably from 3 to 50. For example, when $R^3$ is a hydrogen atom, p may be selected from a range of from 10 to 35, or from 15 to 30, or from 20 to 25; and when $R^3$ is a methyl group, then p may be selected from a range of from 1 to 20, or from 3 to 16, or from 5 to 14.

In formula (1), when n is 2 or more, then A's, $R^3$'s and p's in n' side chains bonding to n' recurring units may be all the same or different. For example, all $R^3$'s may be hydrogen atoms or methyl groups; or may be hydrogen atom and methyl group as combined. In case where $R^3$'s are hydrogen atom and methyl group as combined, then all p' $R^3$'s constituting one side chain are preferably any of hydrogen atoms or methyl groups.

In formula (1), M represents an alkali metal, including Li, Na, K, etc. Preferably, M is Li having a small ion radius, from the viewpoint of the electroconductivity of the polymer. When n is 2 or more, then n' M's may be the same or different, but are preferably the same.

In formula (1), m indicates an integer of from 0 to 300; n indicates an integer of from 1 to 300; and p indicates an integer of from 1 to 100. Preferably, m is an integer of from 0 to 200; n is an integer of from 10 to 200; and p is an integer of from 3 to 50.

m' recurring units and n' recurring units may be so bonded that they form a block copolymer, or form a random copolymer.

The production method for the antistatic agent having a structure of formula (1) is not specifically defined, and the agent may be produced according to any known production methods optionally as combined. In general, the agent may be produced by copolymerizing a (meth)acrylate monomer having $R^1$ and $R^4$, and a (meth)acrylate monomer having $R^2$ and an alkylene oxide group. Concretely, these monomers are dissolved in an inert organic solvent, then a polymerization initiator is added thereto, and these are heated with stirring generally at from 65 to 150° C. to produce the intended copolymer. The polymerization time is defined generally to fall between 1 and 24 hours.

Specific examples of the (meth)acrylate monomer having $R^1$ and $R^4$ include alkyl (meth)acrylates such as methyl (meth)acrylate, ethyl (meth)acrylate, butyl (meth)acrylate, isobutyl (meth)acrylate, tertiary butyl (meth)acrylate, cyclohexyl (meth)acrylate, 2-ethylhexyl (meth)acrylate, lauryl (meth)acrylate, tridecyl (meth)acrylate, stearyl (meth)acrylate, etc.

The (meth)acrylate monomer having $R^2$ and an alkylene oxide group may be produced by introducing an alkali metal into an alkylene oxide monomer. Examples of the alkylene oxide monomer preferably used in the invention include, for example, (poly)alkylene oxide (meth)acrylates such as (poly)

ethylene glycol (meth)acrylate, (poly) propylene glycol (meth)acrylate, (poly)chloroethylene glycol (meth)acrylate, (poly)tetramethylene glycol (meth)acrylate, methoxy(poly) ethylene glycol (meth)acrylate, methoxy(poly)propylene glycol (meth)acrylate, etc. Further mentioned are alkylene oxide monomers having a linking group except a single bond at the site corresponding to A in formula (1) in these specific examples. For example, as compounds having an urethane bond in A, herein usable are the compounds described in JP-A 09-113704. The method of introducing an alkali metal corresponding to M to the monomer is not specifically defined; but in general, an alkylene oxide monomer is reacted with an alkali metal salt to thereby ionize the terminal hydroxyl group for making the resulting polymer have ion-conductivity resulting from the alkali metal ion. In the invention, preferred examples of the alkali metal salt include inorganic salts such as perchlorates with lithium, sodium or potassium, as well as chlorides, bromides, iodides, thiocyanides and the like thereof.

The polymerization initiator for use in copolymerization is preferably liphophilic, and preferred examples of the polymerization initiator include organic peroxides, azonitriles, etc. The organic peroxides include alkyl peroxides (dialkyl peroxides), aryl peroxides (diaryl peroxides), acyl peroxides (diacyl peroxides), aroyl peroxides (diaroyl peroxides), ketone peroxides, peroxy-carbonates (peroxy-dicarbonates), peroxy-carboxylates, hydroperoxides, peroxyketals, peroxyesters, etc. The alkyl peroxides include diisopropyl peroxide, di-tertiary butyl peroxide, tertiary butyl hydroperoxide, etc. The aryl peroxides include dicumyl peroxide, cumyl hydroperoxide, etc. The acyl peroxides include dilauryl peroxide, etc. The aroyl peroxides include dibenzoyl peroxide, etc. The ketone peroxides include methyl ethyl ketone peroxide, cyclohexanone peroxide, etc. The azonitriles include azobisisobutyronitrile, azobisisopropionitrile, etc.

Preferably, the molecular weight of the polymer antistatic agent for use in the invention is within a range of from 10,000 to 1,000,000, in terms of the weight-average molecular weight thereof as measured through gel permeation chromatography (GPC). When the antistatic agent has a molecular weight of at least 10,000, then it hardly bleed out from the formed toner-receiving layer, and the sheet may tend to have sufficient water resistance. When the antistatic agent has a molecular weight of at most 1,000,000, then it may be readily miscible with a binder ingredient and causes little coating failure, and the sheet may tend to have a uniform antistatic effect.

The polymer antistatic agent may be added to the toner-receiving layer in the invention in such a manner that the alkali metal ion concentration in the layer could be preferably from 0.01 to 1% by weight, more preferably from 0.01 to 0.7% by weight, even more preferably from 0.01 to 0.5% by weight. When the alkali metal ion concentration in the layer is at least 0.01% by weight, then the layer may well have an antistatic effect, and in continuous printing in an electrophotographic printer, the printed sheets as discharged out of the printer may be readily prevented from blocking together. When the concentration is at most 1% by weight, the layer may be free from excessive hydrophilicity increase owing to the increase in the metal ions therein, and therefore the water-resistant adhesiveness of toner to the layer may be readily secured. The alkali metal ion concentration is expressed herein as a value to be defined in producing the toner-receiving layer, but may be determined through analysis according to a method of ICP emission spectrometry after dry ashing treatment of the sheets.

The amount of the polymer antistatic agent to be added to the toner-receiving layer may be suitably determined based on the alkali metal ion concentration in the layer, and is preferably within a range of from 1 to 50% by weight, more preferably from 2 to 45% by weight, even more preferably from 3 to 40% by weight. When the amount is at least 1% by weight, then the agent may be uniformly dispersed in the toner-receiving layer and therefore, the layer may readily have a sufficient polymer antistatic effect. When at most 50% by weight, the amount may be well balanced with the amount of the binder resin and the pigment particles added to the layer, and the sheet may be free from a trouble of toner fixation failure.

(Binder Resin)

The toner-receiving layer in the invention preferably contains a binder resin for making the layer have good toner fixability and strong and firm water resistance.

Preferably, the binder resin for use in the invention is a water-insoluble binder. Using a water-insoluble binder produces a toner-receiving layer excellent in water resistance. The water-insoluble binder includes, for example, urethane resin, terpene resin, petroleum resin, ethylene-vinyl acetate copolymer resin, vinyl chloride resin, vinyl chloride-vinyl acetate copolymer resin, vinylidene chloride resin, vinyl chloride-vinylidene chloride copolymer resin, acrylate copolymer resin, methacrylate copolymer resin, chlorinated polyethylene resin, chlorinated polypropylene resin, butyral resin, silicone resin, polyester resin, nitrocellulose resin, styrene-acrylic copolymer resin, styrene-butadiene copolymer resin, etc. One or more of these binder resins may be used either singly or as combined. Of those, preferred are urethane resin such as polyether-urethane, polyester-urethane, acrylic urethane, etc., or acrylate copolymer resin, as highly compatible (miscible) with the above-mentioned antistatic agent comprising an alkylene oxide compound. Other advantages are that the coating composition prepared by mixing the ingredients is stable and is easy to apply to substrates, and the toner well adheres to the formed toner-receiving layer. The content of the binder resin in the toner-receiving layer is preferably from 10 to 99% by weight, more preferably from 15 to 98% by weight, even more preferably from 20 to 97% by weight. When the content is at least 10% by weight, then the toner-receiving layer may have a sufficient cohesive force, and therefore the image electrophotographically formed on the sheet tends to hardly peel away. When the content is at most 99% by weight, then the sheet tends to easily have the intended antistatic effect.

(Organic Solvent)

Not specifically defined, the organic solvent for use in the invention may be any ordinary organic solvent. Preferred are those having a solubility parameter (hereinafter referred to as SP value) of from 6 to 12, more preferably from 7 to 11. The solubility parameter (SP value) has the same meaning as a solubility coefficient, and this is a characteristic value of a liquid to be a criterion of the miscibility between liquids. The SP value is represented by δ, the molecular cohesion energy of liquid is represented by E, and the molecular volume is by V; then the SP value δ is represented by $\delta=(E/V)^{1/2}$.

Specific examples of the solvents having an SP value of from 6 to 12 include n-hexane (SP value: 7.3), n-butanol (SP value: 11.4), 2-propanol (SP value: 11.5), toluene (SP value: 8.9), xylene (SP value: 8.8), methyl ethyl ketone (SP value: 9.3), acetone (SP value: 10), methyl isobutyl ketone (SP value: 8.4), cyclohexanone (SP value: 9.9), ethyl acetate (SP value: 9.1), isopropyl acetate (SP value: 8.4), butyl acetate (SP value: 8.5), tetrahydrofuran (SP value: 9.5), ethyl cellosolve (SP value: 9.9), butyl cellosolve (SP value: 8.9), etc. In those having an SP value of at most 12, the binder resin is well soluble; or they tend to prevent the crosslinking reaction in the presence of a crosslinking agent, if any, from starting in the solution, therefore effective for enhancing the stability of the coating composition. Those having an SP value of at least 6 are not so much volatile and therefore may be handled with ease.

(Pigment Particles)

If desired, the toner-receiving layer in the invention may contain pigment particles. The toner-receiving layer may contain pigment particles in an amount of from 0 to 70% by weight. Accordingly, the layer may contain pigment particles in an amount of up to 70% by weight, or may not contain them.

Pigment particles may be in the layer, as suitably selected for the purpose of imparting various functions to the layer, for example, for enhancing the toner fixability owing to their oil absorbability, for enhancing the surface feel and the glossiness as a body pigment, for enhancing the whiteness as a white pigment, for enhancing the antiblocking property by surface roughening, etc. As the pigment particles, usable are organic and inorganic fine powders, and their specific examples include silicon oxide, calcium carbonate, calcined clay, titanium oxide, zinc oxide, barium sulfate, diatomaceous earth, acrylic resin particles, styrene resin particles, polyethylene resin particles, polypropylene resin particles, etc. Preferably, the particle size of the pigment particles is at most 20 μm, more preferably at most 15 μm. The pigment particles having a particle size of at most 20 μm are hardly drop off from the formed coating layer, and therefore the layer may be prevented from powdering on the surface. The content of the pigment particles in the toner-receiving layer is preferably from 0 to 70% by weight, more preferably from 0 to 60% by weight, even more preferably from 0 to 45% by weight. When the content of the pigment particles is at most 70% by weight, then the toner-receiving layer may have a sufficient cohesive force and may be effective for preventing the electrophotographically-formed image from peeling away.

[Coating]

The toner-receiving layer in the invention may be formed by forming a coating layer on a support with a known coating apparatus followed by drying it thereon. Specific examples of the coating apparatus include a die coater, a bar coater, a comma coater, a lip coater, a roll coater, a curtain coater, a gravure coater, a spray coater, a blade coater, a reverse coater, an air knife coater, etc.

The coating amount of the toner-receiving layer is preferably from 0.1 to 20 g/m$^2$ as the dry solid content, more preferably from 0.5 to 8 g/m$^2$. When the coating amount is at least 0.1 g/m$^2$, then the layer may readily exhibit a uniform antistatic capability. When the amount is at most 20 g/m$^2$, the polymer antistatic agent may have little distribution in the thickness direction of the layer depending on the coating condition and the coating environment, and therefore the layer may tend to readily have a stable antistatic capability and water resistance.

[Support]

(Characteristic and Layer Constitution)

The electrophotographic recording sheet of the invention is characterized by having the above-mentioned toner-receiving layer formed on at least one surface of a water-resistant support. The support acts to impart physical strength such as bending elasticity and tensile elasticity to the electrophotographic recording sheet, and to impart whiteness and opacity thereto as a recording sheet, and further it acts to impart water resistance and durability thereto.

The support is preferably one prepared by laminating a water-resistant synthetic resin film on at least one surface of a water-resistant paper material. The lamination may be attained according to a known method of dry lamination, melt lamination or the like. A more preferred lamination method comprises dry lamination of laminating a support and a synthetic resin film via an adhesive layer provided therebetween.

In one preferred embodiment of the electrophotographic recording sheet of the invention, the support has a UV-intercepting layer laminated between the water-resistant paper material and the synthetic resin film. The UV-intercepting layer may serve also as an adhesive layer, or may be provided separately.

(Paper Material)

The paper material for use in the electrophotographic recording sheet of the invention is preferably a water-resistant paper material having a water absorbency according of from 0 to 50 g/m$^2$, as measured according to the Cobb's method based on JIS-P-8140:1998. More preferably, the water absorbency is from 0 to 40 g/m$^2$, even more preferably from 0 to 30 g/m$^2$.

Concretely, it includes one prepared by applying or infiltrating a coating agent having the ability of imparting water resistance, onto or into unprocessed pulp paper; or one prepared by applying or fusing a water-resistant synthetic resin onto or into unprocessed pulp paper; and various processed paper materials are usable, such as bases for diazo photosensitive paper materials, bases for photographic printing paper materials, resin-infiltrated paper materials, resin-coated paper materials, vegetable parchment materials, artificial parchment materials, water-resistant paper materials, oil-resistant paper materials and waterproof paper materials. Further mentioned are olefinic resin films and synthetic paper materials containing an inorganic and/or organic fine powder.

The thickness of the paper material, as measured according to JIS-P-8118:1998, is preferably from 20 to 300 μm, more preferably from 50 to 250 μm.

The olefinic resin film contains an inorganic and/or organic fine powder along with an olefinic resin therein. The composition of the olefinic resin film preferably comprises from 35 to 99% by weight of an olefinic resin, and from 1 to 65% by weight of an inorganic and/or organic fine powder. More preferably, it comprises from 50 to 95% by weight of an olefinic resin, and from 5 to 50% by weight of an inorganic and/or organic fine powder.

The olefinic resin to be in the olefinic resin film includes, for example, ethylenic resins such as high-density polyethylene, medium-density polyethylene, etc.; propylenic resins; and other olefinic resins such as poly(4-methylpent-1-ene), ethylene-cyclic olefin copolymer, etc. Also usable are mixtures of two or more these resins. Of those, preferred are high-density polyethylene and propylenic resin in view of the cost, the water resistance and the chemical resistance thereof.

The propylenic resins include polypropylene of a propylene homopolymer having a different stereospecificity of isotacticity or syndiotacticity; and a propylene-based copolymer with an α-olefin such as ethylene, butene-1, hexene-1, heptene-1, 4-methylpentene-1, etc. The copolymer may be a binary, ternary or quaternary one, or may be a random copolymer or a block copolymer.

The inorganic fine powder that may be in the olefinic resin film includes, for example, calcium carbonate, calcined clay, silica, diatomaceous earth, talc, titanium oxide, barium sulfate, alumina, etc.; and those having a mean particle size of from 0.01 to 15 μm are applicable. As the organic fine powder, applicable is one having a melting point or a glass transition temperature higher than the melting point of the main ingredient resin to be the matrix of the olefinic resin film, and immiscible with the olefinic resin. Concretely, it includes polyethylene terephthalate, polybutylene terephthalate, polycarbonate, nylon-6, nylon-6,6, cyclic olefin homopolymer, cyclic olefin/ethylene copolymer and the like having a melting point of from 120° C. to 300° C. or having a glass transition temperature of from 120° C. to 280° C.

The structure of the olefinic resin film may be a single-layered structure, a two-layered structure of a base layer and a surface layer, a three-layered structure having a surface layer laminated on both surfaces of a base layer, or a multi-layered structure having an additional resin film layer between a base layer and a surface layer; and these multi-layered structures may be produced according to a known method of coextrusion, melt lamination, dry lamination or the like.

In case where the olefinic resin film has a multi-layered structure comprising a base layer and a surface layer, the base layer preferably contains from 45 to 98% by weight of an olefinic resin, and from 2 to 55% by weight of an inorganic and/or organic fine powder. Preferably, the surface layer comprises from 25 to 100% by weight of an olefinic resin, and contains at most 75% by weight of an inorganic and/or organic fine powder or does not contain it. In a more preferred embodiment, the base layer comprises from 50 to 95% by weight of an olefinic resin and contains from 5 to 50% by weight of an inorganic and/or organic fine powder, and the surface layer comprises from 30 to 99% by weight of an olefinic resin and contains from 1 to 70% by weight of an inorganic and/or organic fine powder.

If desired, the olefinic resin film may contain a heat stabilizer, a light stabilizer, a dispersant, a lubricant, etc. For example, the film may contain a steric-hindered phenol-type, phosphorus-containing or amine-type stabilizer as a heat stabilizer in an amount of from 0.001 to 1% by weight, a steric-hindered amine-type, benzotriazole-type or benzophenone-type stabilizer as a light stabilizer in an amount of from 0.001 to 1% by weight, and a silane coupling agent or a higher fatty acid such as oleic acid or stearic acid, a metal soap or the like as a dispersant for inorganic fine powder in an amount of from 0.01 to 4% by weight.

Preferably, the olefinic resin film usable as the substrate layer in the invention is a stretched film produced by stretching in at least one axial direction in its production process. Those having fine pores inside them by stretching may enhance the degree of opacity of recording sheets, or may enhance the electrostatic capacity thereof. For stretching the resin film, employable is any known conventional method of, for example, machine-direction stretching based on the peripheral speed difference between rolls, rolling (machine-direction stretching) with many rolls, cross-direction stretching with a tenter, successive biaxial stretching by combination of the above-mentioned machine-direction stretching and the above-mentioned cross-direction stretching, simultaneous biaxial stretching by combination of a tenter and a linear motor, simultaneous biaxial stretching according to a tubular method, simultaneous biaxial stretching with a pantograph-type stretcher. The temperature in stretching may be suitably selected in accordance with the type of the olefinic resin to be used and the stretching process. Concretely, for propylene homopolymer (melting point, 155 to 167° C.), the temperature is from 110 to 164° C.; for high-density polyethylene (melting point, 121 to 134° C.), the temperature is from 80 to 120° C. In that manner, the stretching temperature is preferably set lower than the melting point of the polymer by from 2 to 60° C. The stretching speed is preferably from 20 to 350 m/min.

Not specifically defined, the draw ratio in stretching may be suitably selected depending on the object and the properties of the olefinic resin to be used. For example, when a propylene homopolymer or a propylene copolymer is used and the film is stretched monoaxially, the draw ratio is preferably from 1.2 to 12 times, more preferably from 2 to 10 times; and when the film is stretched biaxially, the draw ratio as an areal ratio is preferably from 1.5 to 60 times, more preferably from 10 to 50 times. When other olefinic resin is used and the film is stretched monoaxially, the draw ratio is preferably from 1.2 to 10 times, more preferably from 2 to 5 times; and the film is stretched biaxially, the draw ratio as an areal ratio is preferably from 1.5 to 20 times, more preferably from 4 to 12 times. After stretched, if desired, the film is heat-treated (annealed).

Stretched under the above-mentioned condition, the olefinic resin film containing an inorganic and/or organic fine powder may have fine voids (pores) formed inside the film, therefore having a degree of opacity (JIS P-8138) of at least 85%, preferably at least 90% and having a degree of porosity, as defined according to the following formula (1), of from 10 to 60%, preferably from 15 to 45%; and the film is therefore favorable as the paper material for the electrophotographic recording sheet.

$$\text{Degree of Porosity (\%)}=[(\rho_0-\rho)/\rho_0]\times 100 \qquad \text{Formula (1)}$$

wherein $\rho_0$ means the true density of the resin film; $\rho$ means the density of the resin film.

When the stretched film has a degree of porosity of at least 10%, then it may readily control the whiteness, the opacity and the lightweightness of the electrophotographic recording sheet; but on the contrary, when it has a degree of porosity of at most 60%, then the electrophotographic recording sheet may have good strength (tensile strength, bending strength).

The thickness of the olefinic resin film containing an inorganic and/or organic fine powder is, as in the above, preferably within a range of from 20 to 300 μm, more preferably from 50 to 250 μm. When the thickness of the film is at least 20 μm, then the film may readily stretched into a stretched film with voids; and when it is at most 300 μm, then the final product, electrophotographic recording sheet comprising the film may be well rolled into a roll that is favorable for supply and distribution in the market.

Preferably, the olefinic resin film for use herein has an electrostatic capacity of from 4 to 1000 pF/cm$^2$.

(Synthetic Resin Film)

The synthetic resin film for use in the electrophotographic recording sheet of the invention characterizes heat resistance, durability and suitable electrostatic capacity and others of the electrophotographic recording sheet so that electrophotographic information recording may be favorably attained on the sheet.

This is, as combined with the above-mentioned paper material, preferably a water-resistant synthetic resin film.

As the synthetic resin film, used in the invention is a water-resistant insulating synthetic resin film having a thickness of generally from 5 to 100 μm, preferably from 12 to 50 μm. The water-resistant insulating synthetic resin includes crystalline ethylenic resins such as high-density polyethylene, medium-density polyethylene, low-density polyethylene, etc.; crystalline propylenic resins; crystalline olefinic resins such as poly (4-methylpent-1-ene), ethylene-cyclic olefin copolymer, etc.; polyamide resins such as nylon-6, nylon-6,6, nylon-6,10, nylon-6-12, etc.; polyethylene terephthalate and its copolymer prepared by copolymerization of the monomer with any other ingredient; thermoplastic polyester resins such as polyethylene naphthalate, polylactic acid, aliphatic polyester, etc.; other thermoplastic resins such as polycarbonate, atactic polystyrene, isotactic polystyrene, syndiotactic polystyrene, polyphenylene sulfide, etc. Two or more of these may be used, as combined.

Of these thermoplastic resins, preferred is use of the resins having a melting point, as measured according to JIS-K-7121: 1987, of from 180° C. to 300° C., from the viewpoint of imparting favorable heat resistance to the electrophotographic recording sheet. Accordingly, the thermoplastic resin of forming the synthetic resin film for use in the invention is preferably polyamide resin (about 180 to 270° C.), poly(4-methylpent-1-ene) (about 230° C.), isotactic polystyrene (about 240° C.), polycarbonate (about 250° C.), polyester resin (about 260° C.), syndiotactic polystyrene (about 270° C.), polyphenylene sulfide (about 280° C.), etc. When a resin having a melting point of not lower than 180° C. is used as the main ingredient of the synthetic resin film, then the synthetic resin film may hardly deform or melt under heat in a toner fixation step, and therefore the electrophotographic recording sheet may be prevented from greatly deforming, or from sticking to the toner fixation unit (thermofusing roll, etc.), or from damaging the recording apparatus. When a resin having a melting point of not higher than 300° C. is used, then a film having a uniform thickness may be easy to produce, and therefore, it may be easy to make homogeneous information recording on the sheet. The main ingredient in the invention means an ingredient accounting for from 50% by weight to 100% by weight of all the synthetic resin film. When the ingredient account for at least 50% by weight, then the synthetic resin film in the invention may readily exhibit its desired properties. The side ingredients include other thermoplastic resin, filler, etc.

Of those thermoplastic resins, polyester resins are especially preferred as the main ingredient. The polyester resins include, for example, polyesters to be produced through polycondensation of at least one bifunctional carboxylic acid such as terephthalic acid, isophthalic acid, naphthalenedicarboxylic acid, bis-α,β-(2-chlorophenoxy)ethane-4,4'-dicarboxylic acid, adipic acid, sebacic acid or the like, and at least one glycol such as ethylene glycol, triethylene glycol, tetramethylene glycol, hexamethylene glycol, decamethylene glycol or the like. Also mentioned are polyesters to be produced through polycondensation of the above-mentioned bifunctional carboxylic acid and glycol, and an additional hydroxycarboxylic acid that may be polycondensed with them.

Of those polyester resins, especially preferred is polyethylene terephthalate obtained through polycondensation of terephthalic acid and ethylene glycol, as capable of readily producing a film having a uniform thickness, and the film is easy to work and may have a suitable, not too large and not too small electrostatic capacity.

In the invention, a support comprising the water-resistant paper material and the water-resistant synthetic resin film mentioned above is used, therefore greatly enhancing the water resistance of the electrophotographic recording sheet, and this is a more preferred embodiment of the invention.

(Adhesive Layer)

In forming the support for use in the electrophotographic recording sheet of the invention from the paper material and the synthetic resin film mentioned above, preferably an adhesive layer is used for sticking these and these are laminated via the adhesive layer. The paper material and the synthetic resin film may be stuck together as follows: An adhesive such as a solvent-based adhesive, a hot-melt adhesive or the like is applied onto the paper material or the synthetic resin film according to a method of coating, spraying, melt extrusion lamination or the like to form an adhesive layer thereon, and then the paper material and the synthetic resin film are stuck together via the layer according to an ordinary method of dry lamination, melt lamination using a thermofusible film or a melt extrusion film, or the like.

Typical examples of the solvent-based adhesive include flowable and coatable, solution-type or emulsion-type liquid adhesives that are prepared by dissolving, dispersing, emulsifying and dispersing and/or diluting a resin ingredient such as an acrylic resin, an urethane resin, an ether resin, an ester resin, an epoxy resin, a rubber resin, a silicone resin, an ABS resin or the like, in a phase of a conventional known solvent.

Coating with the coating agent may be attained by the use of a die coater, a bar coater, a comma coater, a lip coater, a roll coater, a rod coater, a curtain coater, a gravure coater, a spray coater, a blade coater, a reverse coater, an air knife coater, a slide hopper or the like. Next, the coating layer is optionally smoothed and dried to give an adhesive layer.

In general, the amount of the adhesive to be applied may be so controlled that the weight of the adhesive layer formed by coating could be from 0.5 to 25 g/m$^2$.

In case where an adhesive is used, the adhesive may be applied onto the surface of a paper material of the substrate layer, then a synthetic resin film is put on it, and adhered thereto under pressure by a press roll; or the adhesive may be applied onto the back of a synthetic resin film, then a paper material of the substrate layer is put on it, and adhered thereto under pressure by a press roll.

Examples of the hot-melt adhesive include polyolefin-based resins such as low-density polyethylene, ethylene/vinyl acetate copolymer, metal salt of ethylene/(meth)acrylic acid copolymer (so-called Surlyn), chlorinated polyethylene, chlorinated polypropylene, etc.; polyamide resins, polybutyral resins, urethane resins, etc.

In case where a hot-melt adhesive is used, it may be applied onto the surface of a paper material of the base layer according to a method of bead coating, curtain coating, slot coating or the like, or it may be extruded and laminated as a film melt on the surface of a paper material of the base layer, and then a synthetic resin film is put on it, and adhered thereto under pressure by a press roll.

The adhesive may contain a UV absorbent capable of absorbing a part of light having a wavelength of from 280 to 400 nm, as mentioned below. Containing such a UV absorbent, it may form an adhesive layer serving also as a UV-intercepting layer.

(UV-Intercepting Layer)

The electrophotographic recording sheet of the invention may have a UV-intercepting layer. Preferably, the UV-intercepting layer is provided between the paper material and the synthetic resin film mentioned above. The UV-intercepting layer is a layer containing a UV absorbent, or a layer containing a UV absorbent and a UV reflectant. Provided in the electrophotographic recording sheet of the invention, the UV-intercepting layer may effectively prevent the paper material inside the sheet from discoloring (yellowing), and enables long-term outdoor use of the sheet.

When a UV-intercepting layer is provided outside the support (for example, when the layer is provided on the toner-receiving layer, or between the toner-receiving layer and the synthetic resin film), then it may unfavorably degrade the water resistance, the solvent resistance and the ink fixability of the sheet. On the other hand, when the synthetic resin film itself is made to serve also as a UV-intercepting layer (for example, when a UV absorbent or the like is kneaded and mixed in the synthetic resin film), then the shapability of the synthetic resin film may worsen and the thickness of the sheet could not be uniform with the result that the intended object of the invention could not be attained. Accordingly, when the UV-intercepting layer is provided, preferably, the layer is formed as a separate layer between the paper material and the synthetic resin film to thereby attain the intended effect of the invention.

The UV absorbent that may be used in the UV-intercepting layer is one capable of absorbing a part of light having a wavelength of from 280 to 400 nm. For example, it includes benzotriazole-type, benzophenone-type, salicylate-type, cyanoacrylate-type, nickel-containing and triazine-type compounds or their mixtures, and any of low-molecular compounds or high-molecular compounds are usable herein.

Specific examples of benzotriazole-type UV absorbents include 2-(2'-hydroxy-5'-methylphenyl)benzotriazole, 2-(2'-hydroxy-3',5'-di-t-butylphenyl)benzotriazole, 2-(2'-hydroxy-3',5'-di-t-amylphenyl)benzotriazole, 2-(2'-hydroxy-3'-t-butyl-5'-methylphenyl)-5-chlorobenzotriazole, 2-(2'-hydroxy-3'-(1-methyl-1-phenylethyl)-5'-1,1,3,3-tetramethylbutylphenyl)benzotriazole, 2-(2'-hydroxy-3'-t-butyl-5'-(2-octyloxycarbonyl)ethylphenyl)benzotriazole, etc. Specific examples of benzophenone-type UV absorbents include 2,4-dihydroxybenzophenone, 2-hydroxy-4-methoxybenzophenone, 2-hydroxy-4-n-octoxybenzophenone, 2-hydroxy-4-n-dodecyloxybenzophenone, 2,2'-dihydroxy-4-methoxybenzophenone, 2,2'-dihydroxy-4,4'-dimethoxybenzophenone, 2,2',4,4'-tetrahydroxybenzophenone, etc. Specific examples of salicylate-type UV absorbents include phenyl salicylate, 4-t-butylphenyl salicylate, 2,4-di-t-butylphenyl 3',5'-di-t-butyl-4'-hydroxybenzoate, etc. Specific examples of cyanoacrylate-type UV absorbents include ethyl (β,β-diphenyl)cyanoacrylate, 2-ethylhexyl (β,β-diphenyl) cyanoacrylate, etc. Specific examples of nickel-containing UV absorbents include [2,2-thiobis(4-t-octylphenolato)]-n-octylamine nickel salt, [2,2-thiobis(4-t-octylphenolato)]-2-ethylhexylamine nickel salt, nickel dibutyldithiocarbamate, etc. Specific examples of triazine-type UV absorbents include 2-(4,6-diphenyl-1,3,5-triazin-2-yl)-5-[(hexyl)oxy]-phenol, etc. Of those, preferred are benzotriazole-type UV absorbents, 2-(2'-hydroxy-3'-(1-methyl-1-phenylethyl)-5'-1,1,3,3-tetramethylbutylphenyl)benzotriazole (CAS No. 73936-91-1), 2-(2'-hydroxy-3'-t-butyl-5'-(2-octyloxycarbonyl) ethylphenyl)benzotriazole (CAS No. 127519-17-9).

The UV reflectant usable in the UV-intercepting layer is one capable of reflecting and/or scattering a part of light having a wavelength of from 280 to 400 nm. For example, it includes any of zinc oxide, titanium oxide, cerium oxide, tungsten oxide, strontium titanate, or their mixtures.

The UV absorbent and the UV reflectant may be used alone, or may be used as combined.

The UV-intercepting layer preferably contains at least one UV absorbent. In case where the UV-intercepting layer is formed, containing a UV reflectant alone but not containing a UV absorbent and when the electrophotographic recording sheet of the invention is, after printed thereon, used outdoors, then the discoloration of the electrophotographic recording sheet itself could be reduced but the amount of UV rays applied to the toner and the coating layer on the recording sheet may increase and the toner may be thereby discolored or degraded with the result that the sharpness of the recorded image and the adhesiveness of the image to the sheet may worsen.

The amount of the UV absorbent in the UV-intercepting layer is preferably from 1 to 50% by weight, more preferably from 2 to 40% by weight, even more preferably from 5 to 30% by weight. When the amount of the UV absorbent is at least 1% by weight, then the electrophotographic recording sheet itself exhibits its discoloration-preventing effect, and therefore a sharp recorded image may be easy to form on the sheet. When the amount is at most 50% by weight, then the UV-intercepting layer may well secure its water resistance and solvent resistance.

The UV-intercepting layer may be a single layer or may have a two-layered or more multi-layered structure. A UV absorbent may be added to the adhesive layer that acts to stick the paper material and the synthetic resin film, thereby making the adhesive layer serve also as a UV-absorbent layer.

In case where a UV absorbent is added to the adhesive layer so as to make the adhesive layer serve also as a UV-absorbent layer, the above-mentioned UV absorbent may be added to the above-mentioned ingredients of adhesive layer, in an amount defined in the above.

For forming the UV-intercepting layer separately from the adhesive layer, there may be employed a method of co-extrusion with the paper material and/or the synthetic resin film, a method of melt lamination on the paper material and/or the synthetic resin film, a method of applying a coating composition onto the paper material and/or the synthetic resin film, etc. Of those, preferred is a method comprising mixing the above-mentioned UV absorbent and/or UV reflectant with a known binder ingredient to prepare a coating composition, followed by applying it onto a paper material or a synthetic resin film to thereby form a coating film thereon. Specific examples of the known binder ingredient include oxidized starch, etherified starch, methoxycellulose, carboxymethylcellulose, hydroxyethylcellulose, casein, gelatin, soybean protein, polyvinylpyrrolidone, polyacrylamide, vinyl alcohol, polyacrylic acid, ester-urethane resin, ether-urethane resin, acrylic urethane resin, terpene resin, petroleum resin, ethylene-vinyl acetate copolymer resin, vinyl chloride resin, vinyl chloride-vinyl acetate copolymer resin, vinylidene chloride resin, vinyl chloride-vinylidene chloride copolymer resin, acrylate copolymer resin, methacrylate copolymer resin, butyral resin, silicone resin, polyester resin, nitrocellulose resin, styrene-acryl copolymer resin, styrene-butadiene copolymer resin, etc. Above all, preferred are polyacrylic acid, ester-urethane resin, ether-urethane resin, acrylic urethane resin, ethylene-vinyl acetate copolymer resin, acrylate copolymer resin, methacrylate copolymer resin, styrene-acryl copolymer resin, styrene-butadiene copolymer resin.

The thickness of the UV-intercepting layer is preferably from 0.1 to 30 μm, more preferably from 0.3 to 25 μm, even more preferably from 0.5 to 20 μm. When the thickness is at least 0.1 μm, then the electrophotographic recording sheet may be prevented from discoloring and the sharpness of the image recorded on the sheet may be prevented from lowering. When the thickness is at most 30 μm, then the electrophotographic recording sheet may readily have a uniform thickness and a uniform recorded image may be readily formed thereon.

Accordingly, the layer constitution of the support including the UV-intercepting layer may take embodiments including synthetic resin film/UV-intercepting layer (serving also as adhesive layer)/paper material; synthetic resin film/UV-intercepting layer/adhesive layer/paper material; synthetic resin film/adhesive layer/UV-intercepting layer/paper material; synthetic resin film/adhesive layer/UV-intercepting layer/adhesive layer/paper material.

The UV-intercepting layer for use in the electrophotographic recording sheet of the invention is preferably colorless transparent or white in view of the use of the sheet.

[Protective Layer]

In one embodiment of the electrophotographic recording sheet of the invention, a synthetic resin film may be laminated on one side (surface) of a paper material, then a toner-receiving layer may be provided on the synthetic resin film, and a protective layer of a synthetic resin film may be provided on the other side (back) of the paper material.

The synthetic resin film for use for the protective film may be a water-resistant insulating synthetic resin film having a thickness of generally from 5 to 100 μm, preferably from 12 to 50 μm. The type of the synthetic resin to be used for the protective layer is not specifically defined. For it, for example, usable are nearly the same as those in the synthetic resin film, for example, ethylenic resins such as high-density polyethylene, medium-density polyethylene, etc.; propylenic resins such as polypropylene; homopolymers of an α-olefin having from 2 to 8 carbon atoms such as poly(4-methylpent-1-ene), etc.; copolymers of from 2 to 5 α-olefins such as ethylene-cyclic olefin copolymer, etc.; polyamide resins such as nylon-6, nylon-6,6, nylon-6,10, nylon-6,12, etc.; polyethylene terephthalate and its copolymers prepared through copolymerization of the monomer with any other ingredient; thermoplastic polyester resins such as polyethylene naphthalate, polylactic acid, aliphatic polyester, etc.; polycarbonate; polystyrene resins such as atactic polystyrene, isotactic polystyrene, syndiotactic polystyrene, etc.; polyphenylene sulfide, etc. Two or more of these may be used, as combined.

In case where the above-mentioned adhesive is used in constituting the electrophotographic recording sheet, then the adhesive is applied to both surfaces of a paper material, and then a synthetic resin film is put on the surface of the paper material while a synthetic resin for the protective layer is put on the back thereof, and these are stuck together under pressure with a press roll; or an adhesive is applied to the back of a synthetic resin film to be the protective layer, then a paper material is put on it, and these are stuck together under pressure with a press roll. In case where the above-mentioned hot-melt adhesive is used, then the adhesive may be extruded out as a film melt onto the surface and the back of the paper material through a die and laminated thereon, and a synthetic resin film is put on the surface of the thus-coated paper material while another synthetic resin to be the protective layer is put on the back thereof, and these are stuck together under pressure with a press roll.

[Sticking Paste Layer]

The electrophotographic recording sheet of the invention may have a sticking paste layer formed on one side of the outermost layer thereof. The type and the thickness (coating amount) of the sticking paste layer may be selected in a different manner, depending on the type of the substance to which the layer is stuck, the environment in which the sheet is used, the sticking strength of the sticking paste, etc. The sticking paste layer may be formed generally by applying a solvent-based or water-based sticking paste generally employed in the art onto the sheet followed by drying it. As the sticking paste, usable are natural rubber pastes, synthetic rubber pastes and synthetic polymer pastes such as acrylic pastes, etc. The sticking paste for use herein may be in any form of a solution as dissolved in an organic solvent, a dispersion or an emulsion as dispersed in a water-based solvent, etc. For enhancing the degree of opacity of the electrophotographic recording sheet, a pigment such as titanium white may be added to the sticking paste. The sticking paste layer may be formed by applying a solution of the sticking paste composition onto the silicone-processed surface of a release sheet or a processed sheet, and the thus-formed, sticking paste layer may be transferred onto the electrophotographic recording sheet; or the sticking paste layer may be directly formed on the electrophotographic recording sheet by coating thereon. The sticking paste may be applied, using a die coater, a bar coater, a roll coater, a lip coater, a gravure coater, a spray coater, a blade coater, a reverse coater, an air knife coater, etc. If desired, the coating layer may be smoothed and dried to give the sticking paste layer. The thickness of the sticking paste layer may be selected in a different manner, depending on the use and the object of the label. In general, it may be from 2 to 30 μm, preferably from 5 to 20 μm.

[Release Sheet]

The electrophotographic recording sheet of the invention may have a release sheet on the surface of the sticking paste layer. During electrophotographic recording thereon, the recording sheet may have the release sheet; but in sticking the recorded sheet onto a subject, the release sheet may be removed with no trouble. As the release sheet, usable is any ordinary one. For example, usable is high-quality paper or kraft paper as such; and also usable are processed paper sheets prepared by calendering that paper, or coating it with resin or laminating a film on it; as well as silicone-processed sheets of glassine paper, coated paper, plastic film, etc. In application to electrophotographic recording sheets, in general, the surface of the release sheet to be in contact with the sticking paste layer of the recording sheet is processed with silicone for the purpose of enhancing the releasability of the release sheet from the recording sheet.

[Physical Properties of Electrophotographic Recording Sheet]

(Specific Surface Resistivity)

The specific surface resistivity of the electrophotographic recording sheet of the invention is measured according to the method mentioned below. Concretely, a electrophotographic recording sheet of the invention is cut into a piece having a size of 10×10 cm square, this is conditioned in an atmosphere at a temperature of 25° C. and a relative humidity of 20% for at least 2 hours to prepare a test sample. Next, in the same environment, the toner-receiving layer of the test sample is analyzed with an electric non-conductance meter (DKK Toa Corporation's Model DSM-8103) using the electrode described in JIS-K-6911 to measure the specific surface resistivity (Ω) thereof.

The specific surface resistivity measured on the toner-receiving layer side of the electrophotographic recording sheet of the invention falls within a range of from $1\times10^{7}$ to $9\times10^{12}\Omega$ in the environment at a temperature of 25° C. and a relative humidity of 20%, preferably from $1\times10^{8}$ to $9\times10^{12}\Omega$. In case where the specific surface resistivity is less than $1\times10^{7}\Omega$, then the toner may be abnormally transferred or a once-transferred toner may reflow when the recording sheet is brought into contact with a ground wire or the like inside the electrophotographic recording apparatus, therefore making it impossible to form a sharp image. When the specific surface resistivity is more than $9\times10^{12}\Omega$, then the antistatic effect of the layer may be insufficient and the recorded sheets discharged out of the recording apparatus may block together. In order to ensure the antistatic capacity of the electrophotographic recording sheet just after discharged out of the electrophotographic recording apparatus in the invention, the specific surface resistivity of the sheet is measured in an extremely severe environment at an extremely low humidity; but it is desirable that the specific surface resistivity of the electrophotographic recording sheet of the invention still falls within that range even when measured in an atmosphere at a temperature of 23° C. and a relative humidity of 50% that is generally employed for measurement of the specific surface resistivity.

(Electrostatic Capacity)

Preferably, the electrostatic capacity per a unit electrode area of the electrophotographic recording sheet of the invention is from 10 to 300 pF/cm$^2$, more preferably from 12 to 250 pF/cm$^2$, even more preferably from 15 to 200 pF/cm$^2$. When the electrostatic capacity of the electrophotographic recording sheet is at least 10 pF/cm$^2$, then the toner transferability onto the sheet may be enhanced and the print density can be readily on a practicable level. When the electrostatic capacity of the electrophotographic recording sheet is at most 300 pF/cm$^2$, then a sharp recorded image of good gradation is easy to form. On the other hand, when the electrostatic capacity is more than 300 pF/cm$^2$, then the toner charge could not be stable and the toner may scatter before thermally fixed on the layer, therefore bringing about a problem of sharp image formation failure, and in addition, there may occur still another problem in that the scattering toner may re-adhere to the sheet to contaminate it, or the excessive toner may be transferred onto the sheet to give a gradation-less image.

In case where the electrostatic capacity of the electrophotographic recording sheet falls within the desired range, then the recording sheet may be sufficiently charged to have an electrical charge, and therefore, the toner adhering to the photoreceptor drum after exposure can be efficiently transferred and adhered to the sheet to thereby give a good recorded material of high quality of good density, good color tone and good gradation, and the recorded material can secure good toner fixation thereon.

The electrostatic capacity includes a parallel equivalent capacitance or a series equivalent capacitance. In general, for measurement of equivalent capacitance, the measuring method is selected depending on the frequency range for the measurement. When the frequency for measurement is at most 10 Hz, then an ultra-low frequency bridge may be used; when it is from 10 Hz to 3 MHz, then a transformer bridge may be used; and when it is more than 1 MHz, then a parallel T-type bridge, a high-frequency shear bridge, a Q meter, or a resonance method, a standing-wave method, or a cavity resonance method may be employed. Also employable for the measurement is an LCR meter or the like, with which the voltage/current vector to the circuit part is measured relative to the alternating current signal of the frequency in measurement, and the electrostatic capacity is computed from the data.

As the apparatus for measurement of the electrostatic capacity of the recording sheet, preferred is one in which a sample is sandwiched between a tabular voltage application electrode and a tabular guard electrode disposed in parallel to each other, under a predetermined pressure, and a voltage of about 5 V can be applied to the sample, and the frequency in measurement can be determined in any desired manner. Using the apparatus for measurement of the type, the frequency dependence of the sample can be known by changing the frequency in measurement, and this can be an index of the suitable range of application of the apparatus to the sample. Preferably, the thickness of the sample is as uniform as possible and the surface thereof is as smooth as possible. When the surface condition of the sample is not good, then voids (air layer) may be formed between the sample and the electrode, thereby giving a serious error to the found data. In this case, in order to secure complete electric contact between the sample and the electrode, it is desirable that a silver electroconductive paste is applied thereto by coating or by vapor deposition. Specific examples of the apparatus for measurement include Agilent Technologies' "4192A LF IMPEDANCE ANALYZER", Yokogawa Electric's "LCR Meter 4274A", Hioki Electric's "HIOKI 3522 LCR HiTESTER", etc.

For measurement of the electrostatic capacity of the electrophotographic recording sheet of the invention, used is Agilent Technologies' "4192A LF IMPEDANCE ANALYZER". Under the environment condition at a temperature of 23° C. and a relative humidity of 50%, a sample larger than the electrode diameter is put between the main electrode having a diameter of 38 mm and the counter electrode having a diameter of 56 mm, then a voltage of 5 V is applied thereto, and the sample is analyzed at a frequency falling within a range of from 10 Hz to 1 MHz. The data measured at a frequency of 300 Hz are the typical data.

<<Recording on Electrophotographic Recording Sheet>>

[Recording Apparatus]

Using an electrophotographic recording apparatus such as a duplicator, a laser printer or the like, good color recording can be made on the electrophotographic recording sheet of the invention. An electrophotographic color recording system includes three types, (1) an intermediate transfer system where each one color of an image is transferred as intermediate transference, then plural colors thereof are transferred onto an intermediate transfer body, and thereafter transferred and developed on a recording sheet; (2) a tandem system where two or more photoreceptors are used, plural colors of an image are, one by one, transferred and developed on a recording sheet; and (3) a tandem+transfer system using two or more photoreceptors where plural colors of an image are, one by one, transferred onto an intermediate transfer body, and then transferred and developed on a recording sheet. In the invention, the systems (2) and (3) are generically referred to as "tandem system". The electrophotographic recording sheet of the invention is usable in the intermediate transfer system (1), but is favorable for use in the tandem system of (2) and (3). When the system (1) comprises a small-sized electrophotographic duplicator or the like, the electrophotographic recording sheet may be roughly rubbed inside the apparatus while transferred therethrough, and its use may be often difficult. The tandem system of (2) and (3) is applicable to high-speed processing and is therefore favorable, since the electrophotographic recording sheet is not too much rubbed while transferred therethrough because of the structural reason of the apparatus.

Before recording thereon using the above-mentioned recording apparatus, the electrophotographic recording sheet of the invention may be printed in an ordinary manner, for example, by oily offset printing, UV offset printing, gravure printing, flexographic printing or the like. If desired, bar codes for management may be printed on the sheet according to a thermal transfer system or an electrophotographic system. For sales promotion and for visibility enhancement, the electrophotographic recording sheet of the invention may be printed entirely or partly on the back of the synthetic resin film thereof (opposite side to the toner-receiving layer), before laminated with a substrate layer. Similarly, on the surface of the paper material to be laminated with a synthetic resin film, the sheet may be printed entirely or partly, before laminated with the synthetic resin film. Preferably, the printing is so attained that, when the printed sheet is seen via the synthetic resin film thereof, then it may show the regular information.

[Recorded Material]

The recorded material of the electrophotographic recording sheet of the invention includes POP cards (posters, stickers, displays, etc.), store guidance notes (pamphlets, company guidance notes, bills of fare, menus, etc.), desk pads (lunch mats, table mats, stationery articles, etc.), manuals (various manuals for duty, work, operation, etc., progress schedules, timetables, etc.), charts (nautical charts, weather charts, graphs, ruled line tables, etc.), catalogs, cards (price cards, point cards, member's cards, various membership certificates, student ID card, employee ID cards, entrance and exit permits, association ID cards, identification cards, student attendance cards, book cards, hospital cards, management cards, parking permits, ski coupons, CD, MD title cards, CD, MD index cards, photo cards, etc.), panels, plates (substitute for metal plates), bromides (movie star photographs), save documents (word processor documents, various lists, appraisals, certificates, important documents, letters of commendation, etc.), illustrated books, drawings (building drawings, engineering works spot drawings, etc.), maps (nautical charts, route charts, outdoor maps, etc.), commuter passes, store price lists, mountain climbing guidebooks, calling cards, child's ID cards, cooking recipes, guide boards (sales floor guidance, direction/destination guidance, confectionery/foods, etc.), gardening POP (hanging label, insert labels, etc.), schedule tables, road signs (for funerals, house exhibition space, etc.), circular notices, room cards, record lists in school, sign boards (for "closed to the public", forestry road works, etc.), section poles, nameplates, calendars (with images), simple white boards, postcards, greeting cards, handbills, picture books, picture-story shows, mobile timetables, albums, picture diaries, paper works (paper kraft), copy originals, hand fans, megaphones, mouse pads, bookmarks, toilets for pets, wrapping materials (wrapping sheets, boxes, bags, etc.), coasters, flowerpots, laminate-free printed materials, printed materials substitute for label writers, adhesive labels, tags (aviation tags, IC tags, triage tags), etc., and the recorded material of the invention is applicable to any of these. In particular, it is favorable for application to essentially outdoor-use materials.

EXAMPLES

The invention is described concretely with reference to the following Preparation Examples, Production Examples, Examples and Comparative Examples. In the following Examples, the material used, its amount and the ratio, the details of the treatment and the treatment process may be suitably modified or changed not overstepping the spirit and the scope of the invention. Accordingly, the invention should not be limited to the concrete Examples mentioned below.

Preparation Example 1 for Binder Resin 15 parts by weight of 2-hydroxyethyl methacrylate (by Wako Pure Chemical Industries, chemical reagent), 50 parts by weight of methyl methacrylate (by Wako Pure Chemical Industries, chemical reagent), 35 parts by weight of ethyl acrylate (by Wako Pure Chemical Industries, chemical reagent) and 100 parts by weight of toluene were put into a three-neck flask equipped with a stirrer, a reflux condenser and a thermometer, then purged with hydrogen, and 0.6 parts by weight of an initiator, 2,2'-azobisisobutyronitrile (by Wako Pure Chemical Industries, chemical reagent) was added thereto, and these were polymerized at 80° C. for 4 hours. The obtained solution was a 50 wt. % toluene solution of a hydroxyl group-containing (meth)acrylate copolymer resin having a hydroxyl value of 65. Next, 40 parts by weight of a 20 wt. % methyl ethyl ketone solution of a vinyl chloride/vinyl acetate copolymer (by Shin-Daiichi-Enbi KK, trade name: ZEST C150ML), and 20 parts by weight of a 75 wt. % ethyl acetate solution of hexamethylene diisocyanate (by Nippon Polyurethane Industry, trade name: Coronate HL) were added to 100 parts by weight of the solution, and a mixed solvent of toluene/methyl ethyl ketone (1/1) was further added to the resulting mixture to control the solid content therein to be 20% by weight, thereby giving a binder resin solution.

Preparation Example 2 for Binder Resin 100 parts by weight of poly[(3-methyl-1,5-pentanediol)-alt-(adipic acid)] (by Kuraray, trade name: Kuraray Polyol P-2010), and 20 parts by weight of isophorone diisocyanate (by Wako Pure Chemical Industries, chemical reagent) were put into a three-neck flask equipped with a stirrer, a reflux condenser and a thermometer, then purged with hydrogen, and polymerized at 100° C. for 8 hours. 210 parts by weight of methyl ethyl ketone was added thereto little by little with stirring, then cooled to 40° C. to give a methyl ethyl ketone solution of an urethane resin. Next, a mixed solution of 8 parts by weight of 3-aminomethyl-3,5,5-trimethylcyclohexylamine (by Wako Pure Chemical Industries, chemical reagent), 100 parts by weight of methyl ethyl ketone, and 50 parts by weight of 2-propanol was added thereto, then reacted at 40° C. for 4 hours, and thereafter methyl ethyl ketone was further added thereto to control the solid content to be 20% by weight, thereby giving a binder resin solution.

Preparation Example 1 for Polymer Antistatic Agent 100 parts by weight of polyethylene glycol monomethacrylate (by Nippon Yushi, trade name: Blemmer PE-350), 20 parts by weight of lithium perchlorate (by Wako Pure Chemical Industries, chemical reagent), 1 part by weight of hydroquinone (by Wako Pure Chemical Industries, chemical reagent), and 400 parts by weight of methyl ethyl ketone were put into a four-neck flask equipped with a stirrer, a condenser, a nitrogen-introducing duct, and a thermometer, and the system was purged with nitrogen, and reacted at 60° C. for 40 hours. 20 parts by weight of stearyl methacrylate (by Wako Pure Chemical Industries, chemical reagent), 20 parts by weight of n-butyl methacrylate (by Wako Pure Chemical Industries, chemical reagent), and 1 part by weight of azobisisobutyronitrile (by Wako Pure Chemical Industries, chemical reagent) were added to it, and polymerized at 80° C. for 3 hours, then methyl ethyl ketone was added thereto to control the solid content to be 20% by weight, thereby giving a polymer antistatic agent solution in which the polymer had a weight-average molecular weight of about 300,000 and the lithium concentration in the solid fraction was 0.8% by weight.

Preparation Example 2 for Polymer Antistatic Agent 60 parts by weight of polyethylene glycol having a weight-average molecular weight of 1000 (by Wako Pure Chemical Industries, chemical reagent), 40 parts by weight of polypropylene glycol having a weight-average molecular weight of 600 (by Wako Pure Chemical Industries, chemical reagent), 15 parts by weight of lithium perchlorate (by Wako Pure Chemical Industries, chemical reagent), and 400 parts by weight of methyl ethyl ketone were put into a four-neck flask equipped with a stirrer, a condenser, a nitrogen-introducing duct, and a thermometer, and the system was purged with nitrogen, and reacted at 80° C. for 10 hours. 30 parts by weight of isophorone diisocyanate (by Wako Pure Chemical Industries, chemical reagent), and 0.5 parts by weight of 1,8-diazabicyclo[5.4.0]undecene-7 (by San-apro, trade name: DBU) were added to it to attain urethanation at 80° C. for 4 hours; and 20 parts by weight of methacrylic acid (by Wako Pure Chemical Industries, chemical reagent), and 0.2 parts by weight of hydroquinone (by Wako Pure Chemical Industries, chemical reagent) were added to it to attain esterification at 60° C. for 4 hours. In addition, 10 parts by weight of stearyl methacrylate (by Wako Pure Chemical Industries, chemical reagent), 5 parts by weight of n-butyl methacrylate (by Wako Pure Chemical Industries, chemical reagent), and 2 parts by weight of azobisisobutyronitrile (by Wako Pure Chemical Industries, chemical reagent) were added to it, and polymerized at 80° C. for 3 hours, and then methyl ethyl ketone was added to it to control the solid content to be 20% by weight, thereby giving a polymer antistatic agent solution in which the polymer had a weight-average molecular weight of about 100,000 and the lithium concentration in the solid fraction was 0.6% by weight.

Production Example 1 for Support

A synthetic resin film, polyethylene terephthalate film having a thickness of 25 μm (by Toray, trade name: Lumirror, melting point: 260° C.) was prepared; and an adhesive coating composition comprising 60 parts by weight of a polyether-urethane adhesive (by Toyo Morton, trade name: TM-317), 40 parts by weight of a polyisocyanate curing agent (by Toyo Morton, trade name: CAT-11B), and 5 parts by weight of a benzotriazole UV absorbent (by Ciba Speciality Chemicals, trade name: Tinuvin-384-2) was applied to it so that the dry solid content of the coating layer could be 4 g/m$^2$, and dried at 60° C. for 1 minute, thereby providing an adhesive layer serving also as a UV-intercepting layer. This was put on the surface and the back of a water-resistant paper material, printing paper OTP base having a thickness of 170 μm (by Oji Paper Milling, Cobb's method water absorbency: 24.8 g/m$^2$, weight: 175 g/m$^2$), and adhered thereto under pressure, thereby giving a water-resistant support having a thickness of 220 μm and having a 5-layered structure (PET film/adhesive layer/printing paper OTP base/adhesive layer/PET film).

Production Example 2 for Support

An adhesive coating composition comprising 60 parts by weight of a polyether-urethane adhesive (by Toyo Morton, trade name: TM-317), 40 parts by weight of a polyisocyanate curing agent (by Toyo Morton, trade name: CAT-11B), and 5 parts by weight of a benzotriazole UV absorbent (by Ciba Speciality Chemicals, trade name: Tinuvin-384-2) was applied to a polyethylene terephthalate film having a thickness of 25 μm (by Toray, trade name: Lumirror, melting point: 260° C.) so that the dry solid content of the coating layer could be 4 g/m$^2$, and dried at 60° C. for 1 minute. This was put on the surface and the back of synthetic paper having a thickness of 80 μm (by Yupo Corporation, trade name: KPK-80, Cobb's method water absorbency: 1 g/m$^2$, weight: 82 g/m$^2$), and adhered thereto under pressure, thereby giving a water-resistant support having a thickness of 135 μm and having a 5-layered structure (PET film/adhesive layer/synthetic paper/adhesive layer/PET film).

Examples 1 to 4

Comparative Examples 1 to 2

Electrophotographic recording sheets of Examples 1 to 4 and Comparative Examples 1 to 2 were produced according to the process mentioned below, using the materials of the above-mentioned Preparation Examples and Production Examples and in Table 1, in the ratio shown in Table 2.

The metered pigment particles were added little by little to methyl ethyl ketone gently stirred in a Cowless mixer in such a controlled manner that the solid concentration in the resulting mixture could be 20% by weight; then the number of revolutions of the Cowless mixer was increased, and this was stirred for 30 minutes to prepare a pigment dispersion. Next, the number of revolutions of the Cowless mixer was decreased, and the binder resin solution, the polymer antistatic agent solution and the curing agent (diluted with ethyl acetate to have a solid content of 20% by weight) were added to the dispersion in that order, then kept stirred for 20 minutes as such, and filtered through a 100-mesh filter to remove coarse particles thereby preparing a coating liquid for toner-receiving layer.

Using a bar coater, the coating liquid was applied onto one surface of the support in a predetermined coating amount (as dry solid content), and dried in a drier set at 70° C. for 1 minute, thereby producing electrophotographic recording sheets of Examples and Comparative Examples.

Except in Example 3, both the surface and the back of the support were coated according to the same process, thereby producing electrophotographic recording sheets having the same toner-receiving layer on both sides thereof.

Test Examples

The electrophotographic recording sheets of Examples 1 to 4 and Comparative Examples 1 to 2 were tested in the manner mentioned below. The results are shown in Table 2. In all the electrophotographic recording sheets, the toner fixability on the toner-receiving layer was good just after recording thereon.

(Evaluation of Recording Quality)

Using a color laser printer (by Casio, trade name: N4-612II), a test image of four color toners of yellow, cyan, magenta and black was recorded on the toner-receiving layer of the electrophotographic recording sheets obtained in the above Examples and Comparative Examples, and the recorded image was visually evaluated in point of the recording quality of density, color tone and gradation, based on the evaluation standards mentioned below.

○: Density, color tone and gradation were all good.

Δ: Recording density was somewhat low.

x: Any of density, color tone and gradation was poor, and the sheet was not on a practicable level.

(Evaluation of Blocking Resistance)

Using a color laser printer (by Casio, trade name: N4-612II), a test image was printed on the toner-receiving layer of the electrophotographic recording sheets obtained in the above Examples and Comparative Examples. 21 sheets were printed continuously, and the printed sheets were piled up and kept horizontally as such. In one minute after the printing, the 11th sheet was tried to be pulled out from the pile of the prints, and the blocking resistance of the sheet was evaluated based on the evaluation standards mentioned below.

○: It could be pulled out by hand.

x: The prints blocked too much, and the intended sheet could not be pulled out by hand.

(Evaluation of Water Resistance)

The recording sheets evaluated in the above-mentioned recording quality evaluation step were dipped in water (ion-exchanged water) filled in a vat in such a manner that they could not float up. Thus, the sheets were dipped in water for 24 hours, and thereafter the recorded image was strongly rubbed with a coin. The sheets were visually evaluated, based on the evaluation standards mentioned below.

○: No change in the recorded image.

x: The recorded image peeled off.

TABLE 1

| Materials | | Details |
|---|---|---|
| Pigment Particles | precipitated silica | precipitated silica having a mean particle size 1.6 μm and an oil absorption 180 ml/100 g (by Mizusawa Industrial Chemicals, trade name: Mizukasil P-527) |
| | barium sulfate | barium sulfate having a mean particle size of 0.3 μm (by Sakai Chemical Industry), trade name: BARIACE B-32) |
| | titanium dioxide | rutile-type titanium dioxide having a mean particle size of 0.25 μm (by Ishihara Sangyo, trade name: Tipaque R-930) |
| Curing Agent | | hexamethylene diisocyanate (by Nippon Polyurethane Industry, trade name: Coronate HL) |

Formula (1)

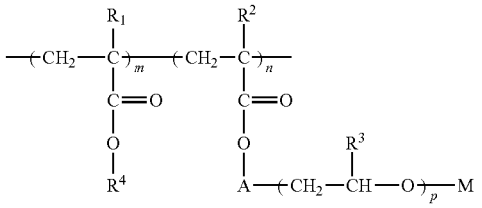

wherein $R^1$ and $R^2$ each independently represent a hydrogen atom or a methyl group; $R^3$ represents a hydrogen atom, a chlorine atom or a methyl group; $R^4$ represents an alkyl group having from 1 to 30 carbon atoms; A represents one linking group selected from the following

TABLE 2

| | | | Example 1 | Example 2 | Example 3 | Example 4 | Comparative Example 1 | Comparative Example 2 |
|---|---|---|---|---|---|---|---|---|
| Formulation of Toner-Receiving Layer (% by weight) | Polymer | Preparation Example 1 | 5 | — | — | 40 | — | 97 |
| | Antistatic Agent | Preparation Example 2 | — | 10 | 40 | — | — | — |
| | Binder Resin | Preparation Example 1 | 62 | — | — | 35 | — | — |
| | | Preparation Example 2 | — | 42 | 55 | — | 52 | — |
| | Pigment Particles | precipitated silica | 25 | 30 | — | 10 | 30 | — |
| | | barium sulfate | — | 15 | — | 10 | 15 | — |
| | | titanium dioxide | 5 | — | | 2 | — | — |
| | Curing Agent | | 3 | 3 | 5 | 3 | 3 | 3 |
| Toner-Receiving Layer | Specific Surface Resistivity (Ω) | | $8 \times 10^{12}$ | $3 \times 10^{12}$ | $7 \times 10^{9}$ | $8 \times 10^{8}$ | $5 \times 10^{15}$ | $4 \times 10^{7}$ |
| | Alkali Metal Content (% by weight) | | 0.04 | 0.06 | 0.24 | 0.32 | 0.00 | 0.80 |
| Support | | | Production Example 1 | Production Example 1 | Production Example 1 | Production Example 2 | Production Example 1 | Production Example 1 |
| Thickness of Support (μm) | | | 220 | 220 | 220 | 135 | 220 | 220 |
| Side coated with toner-receiving layer | | | both sides | both sides | one side | both sides | both sides | both sides |
| Coating Amount (per one side) ($g/m^2$(dry)) | | | 2.0 | 1.5 | 0.5 | 3.0 | 1.5 | 1.0 |
| Thickness of Electrophotographic Recording Sheet (μm) | | | 224 | 223 | 220 | 140 | 223 | 222 |
| Electrostatic Capacity of Electrophotographic Recording Sheet ($pF/cm^2$) | | | 24 | 24 | 25 | 16 | 25 | 25 |
| Evaluation Results | | Recording Quality | ○ | ○ | ○ | ○ | ○ | Δ |
| | | Blocking Resistance | ○ | ○ | ○ | ○ | X | ○ |
| | | Water Resistance | ○ | ○ | ○ | ○ | ○ | X |

Table 2 confirm that the electrophotographic recording sheets of the invention have good recording quality of density, color tone and gradation, that the printed sheets in continuous printing are free from blocking trouble owing to static charges, and the sheets have excellent water resistance.

The invention claimed is:

1. An electrophotographic recording sheet having, on at least one surface of a water-resistant support, a toner-receiving layer containing a liphophilic polymer antistatic agent in an amount of from 1 to 50% by weight and a binder resin in an amount of from 20 to 99% by weight, wherein the specific surface resistivity of the toner-receiving layer at a temperature of 25° C. and a relative humidity of 20% is from $1\times10^{8}$ to $9\times10^{12}\Omega$, wherein the polymer antistatic agent contains an alkylene oxide group and/or a hydroxyl group, and an alkali metal ion; and the polymer antistatic agent has a structure of the following formula (1):

<Group 1>, or a linking group formed by alternately bonding one or more linking groups selected from the following <Group 1>and one or more linking groups selected from the following <Group 2>, or a single bond;

<Group 1>an alkylene group having from 1 to 6 carbon atoms and optionally having a substituent, an arylene group having from 6 to 20 carbon atoms and optionally having a substituent;

<Group 2>—CONH—, —NHCO—, —OCONH—, —NHCOO—, —NH—, —COO—, —OCO—, —O—;

M represents an alkali metal; m indicates an integer of from 1 to 300; n indicates an integer of from 1 to 300; and p indicates an integer of from 1 to 100.

2. The electrophotographic recording sheet according to claim 1, wherein the toner-receiving layer contains from 0.01 to 1% by weight of an alkali metal ion.

3. The electrophotographic recording sheet according to claim 1, wherein the alkali metal ion is a lithium ion.

4. The electrophotographic recording sheet according to claim 1, wherein the binder resin comprises a polyether urethane, a polyester urethane, a polyacrylic urethane, an acrylate copolymer, or their mixture.

5. The electrophotographic recording sheet according to claim 1, wherein the toner-receiving layer is formed by applying an organic solvent solution coating composition containing the above-mentioned polymer antistatic agent and the above-mentioned binder resin, and then drying it to form a coating film thereon.

6. The electrophotographic recording sheet according to claim 1, wherein the support is produced by laminating a synthetic resin film on at least one surface of a water-resistant paper material.

7. The electrophotographic recording sheet according to claim 1, wherein the support is produced by laminating a UV-intercepting layer and a synthetic resin film in that order on at least one surface of a water-resistant paper material.

8. The electrophotographic recording sheet according to claim 6, wherein the water-resistant paper material has a water absorbency, according to the Cobb's method based on JIS-P-8140:1998, of from 0 to 50 $g/m^2$.

9. The electrophotographic recording sheet according to claim 6, wherein the water-resistant paper material is processed paper selected from the group consisting of bases for diazo photosensitive paper, bases for photographic printing paper, resin-infiltrated paper, resin-coated paper, vegetable parchment, artificial parchment, water-resistant paper, oil-resistant paper and waterproof paper.

10. The electrophotographic recording sheet according to claim 6, wherein the water-resistant paper material is a polyolefin film containing an inorganic and/or organic fine powder.

11. The electrophotographic recording sheet according to claim 6, wherein the synthetic resin film contains a thermoplastic resin having a melting point of from 180 to 300° C.

12. The electrophotographic recording sheet according to claim 11, wherein the thermoplastic resin for the synthetic resin film is a polyester resin or poly(4-methylpent-1-ene).

13. The electrophotographic recording sheet according to claim 12, wherein the polyester resin is polyethylene terephthalate.

14. The electrophotographic recording sheet according to claim 7, wherein the UV-intercepting layer contains at least one UV absorbent selected from the group consisting of benzotriazole-type, benzophenone-type, salicylate-type, cyanoacrylate-type, nickel-containing and triazine-type UV absorbents.

15. The electrophotographic recording sheet according to claim 14, wherein the amount of the UV absorbent to be in the UV-intercepting layer is from 1 to 50% by weight of the layer composition.

16. The electrophotographic recording sheet according to claim 1, wherein the electrostatic capacity of the electrophotographic recording sheet is from 10 to 300pF/$cm^2$.

17. An electrophotographic recording sheet having an adhesive layer on one side of the outermost layer of the electrophotographic recording sheet of claim 1.

18. A recorded material comprising the electrophotographic recording sheet of claim 1.

* * * * *